US011229306B2

(12) United States Patent
Schmidt

(10) Patent No.: US 11,229,306 B2
(45) Date of Patent: Jan. 25, 2022

(54) LOCKING KNIFE HOLDER

(71) Applicant: Schmidt Brothers, Inc., Westwood, NJ (US)

(72) Inventor: Jordan Schmidt, Westwood, NJ (US)

(73) Assignee: Brothers Brands, Inc., Westwood, NJ (US)

( * ) Notice: Subject to any disclaimer, the term of this patent is extended or adjusted under 35 U.S.C. 154(b) by 0 days.

(21) Appl. No.: 16/668,212

(22) Filed: Oct. 30, 2019

(65) Prior Publication Data

US 2021/0127876 A1 May 6, 2021

(51) Int. Cl.

| | |
|---|---|
| ***H01F 7/02*** | (2006.01) |
| ***A47G 21/14*** | (2006.01) |
| ***E05B 47/00*** | (2006.01) |
| ***E05B 47/02*** | (2006.01) |
| ***H01F 7/04*** | (2006.01) |
| ***H01F 7/06*** | (2006.01) |

(52) U.S. Cl.

CPC ..... *A47G 21/14* (2013.01); *E05B 47/0042* (2013.01); *E05B 47/023* (2013.01); *H01F 7/0252* (2013.01); *H01F 7/04* (2013.01); *H01F 7/064* (2013.01)

(58) Field of Classification Search

CPC ... E05B 47/0042; E05B 47/023; A47G 21/14; H01F 7/0252; H01F 7/0268; H01F 7/04; H01F 7/064; H01F 7/0226; H01F 7/0263; H01F 2007/206; H01F 2007/208

See application file for complete search history.

(56) References Cited

U.S. PATENT DOCUMENTS

| | | | | | |
|---|---|---|---|---|---|
| 2,565,625 | A * | 8/1951 | Phelon | A47G 21/14 | 335/285 |
| 2,931,953 | A * | 4/1960 | Barney | H01H 27/00 | 361/171 |
| 2,955,239 | A * | 10/1960 | Rouse | H01F 7/0252 | 335/285 |
| 4,251,791 | A * | 2/1981 | Yanagisawa | H01F 7/04 | 335/285 |
| 4,393,363 | A * | 7/1983 | Iwasaki | H01F 7/04 | 335/288 |
| 4,497,412 | A * | 2/1985 | Labelle | A47G 21/14 | 206/350 |

(Continued)

FOREIGN PATENT DOCUMENTS

| | | | | |
|---|---|---|---|---|
| CA | 2982037 A1 * | 2/2019 | | A47G 21/14 |
| KR | 20-2010-0004055 U | 4/2010 | | |
| KR | 10-1426414 B1 | 8/2014 | | |

OTHER PUBLICATIONS

International Search Report from PCT/US20/57618 dated Feb. 18, 2021, 3 pgs.

*Primary Examiner* — Kimberley S Wright
(74) *Attorney, Agent, or Firm* — Tutunjian & Bitetto, P.C.

(57) ABSTRACT

A locking knife holder uses either mechanical or electronic locking systems to secure the knives into the holder. The electronic locking system includes the implementation of one or more electromagnets into the holder. The user can then selectively lock or unlock the knives in the holder by activating or deactivating, respectively the electromagnet. In other implementations, the mechanical locking system can use magnetic keys to unlock the mechanical locking system.

9 Claims, 9 Drawing Sheets

(56) References Cited

U.S. PATENT DOCUMENTS 4,509,651 A * 4/1985 Prindle ..... A47G 21/14 211/70.6
4,586,616 A * 5/1986 Cooper ..... A47J 47/16 211/88.04
5,011,102 A * 4/1991 Kiefer ..... A47G 21/14 211/DIG. 1
5,245,756 A * 9/1993 Howell ..... B24D 15/084 30/151
5,301,822 A * 4/1994 Coleman ..... B25H 3/04 211/70.6
5,917,407 A * 6/1999 Squire ..... B62H 3/00 194/205
6,058,609 A * 5/2000 Yen ..... A47G 21/14 206/553
6,619,487 B2 * 9/2003 Stuchlik, III ..... A47G 21/14 211/70.7
D488,677 S * 4/2004 Reichenbach ..... D7/637
6,920,987 B2 * 7/2005 Siegel ..... A47G 21/14 211/1.3
7,631,772 B2 * 12/2009 Lafleur ..... A47G 21/14 211/70.7
7,934,610 B2 * 5/2011 Zeng ..... A47G 21/14 211/70.7
8,217,743 B2 * 7/2012 Liu ..... H01F 7/20 335/288
8,279,032 B1 * 10/2012 Fullerton ..... G06F 1/1677 335/285
9,445,678 B2 * 9/2016 Gungordu ..... A47J 47/16
10,383,468 B2 * 8/2019 Kerulis ..... A47G 21/14
10,390,661 B1 * 8/2019 Steingraber ..... F16B 1/00
10,548,423 B1 * 2/2020 Rigas ..... A47G 21/14
2003/0038098 A1 * 2/2003 Stuchlik, III ..... A47G 21/14 211/70.7
2008/0060204 A1 * 3/2008 Chen ..... A47G 21/14 30/298.4
2008/0060205 A1 * 3/2008 Schmidt ..... A47G 21/14 30/298.4
2008/0276465 A1 * 11/2008 Lafleur ..... A47G 21/14 30/298.4
2009/0255133 A1 * 10/2009 Bonapace ..... A47G 21/14 30/298.4
2013/0037501 A1 * 2/2013 Schmidt ..... A47G 21/14 211/70.7
2013/0285775 A1 * 10/2013 Fullerton ..... H01F 7/02 335/295
2014/0232500 A1 * 8/2014 Alexander ..... H01F 7/0252 335/306
2015/0279535 A1 * 10/2015 Arrington ..... G06F 1/1632 361/679.43
2015/0297008 A1 * 10/2015 Gungordu ..... A47G 21/14 206/350
2018/0000268 A1 * 1/2018 Zhijian ..... G07C 9/00182
2020/0027767 A1 * 1/2020 Zang ..... H01F 7/02
2020/0052697 A1 * 2/2020 Deniau ..... G06F 3/0362

* cited by examiner

LOCKING KNIFE HOLDER

BACKGROUND

Technical Field

The present invention relates to knife holders and blocks for storage of knives. More particularly, it relates to a locking knife holder or block.

Description of the Related Art

Knife holders, or knife blocks, are designed to store knives in a safe and convenient manner. They allow for storing knives in a way that both protects the blade from damage and prevents a user from cutting themselves. However, the accessibility of all known knife holders allows anyone to remove a knife. This can be especially problematic with young children who do not understand the potential danger of knives.

SUMMARY

In accordance with one implementation, the knife holder includes a body, at least one slot in the body for receiving at least one knife, and a locking mechanism in communication with the at least one slot and configured to selectively lock the at least one knife within the at least one slot.

According to one implementation, the locking mechanism includes an electromagnet positioned in the body, a power source within the body and electrically connected to the electromagnet, and a switch accessible from outside the body and electrically connected to the power source and electromagnet.

According to yet another implementation, the locking mechanism includes a rotating magnet disposed within body and having at least two distinct and different magnetic strengths relative to the at least one slot and thereby relative to the at least one knife. The at least two distinct magnetic strengths being determined based on a rotational position of the magnet relative to the at least one slot. One of said two distinct strengths being high enough to prevent removal of the at least one knife from the at least one slot.

According to another implementation, the knife holder includes a body, electronic circuity inside the body, at least one permanent magnet and at least one electromagnet electrically coupled to the circuit. A switch electrically coupled to the circuity and the at least one electromagnet is configured to selectively activate and deactivate the at least one electromagnet.

Other aspects and features of the present principles will become apparent from the following detailed description considered in conjunction with the accompanying drawings. It is to be understood, however, that the drawings are designed solely for purposes of illustration and not as a definition of the limits of the present principles, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings wherein like reference numerals denote similar components throughout the views.

DETAILED DESCRIPTION

Figure 1A:
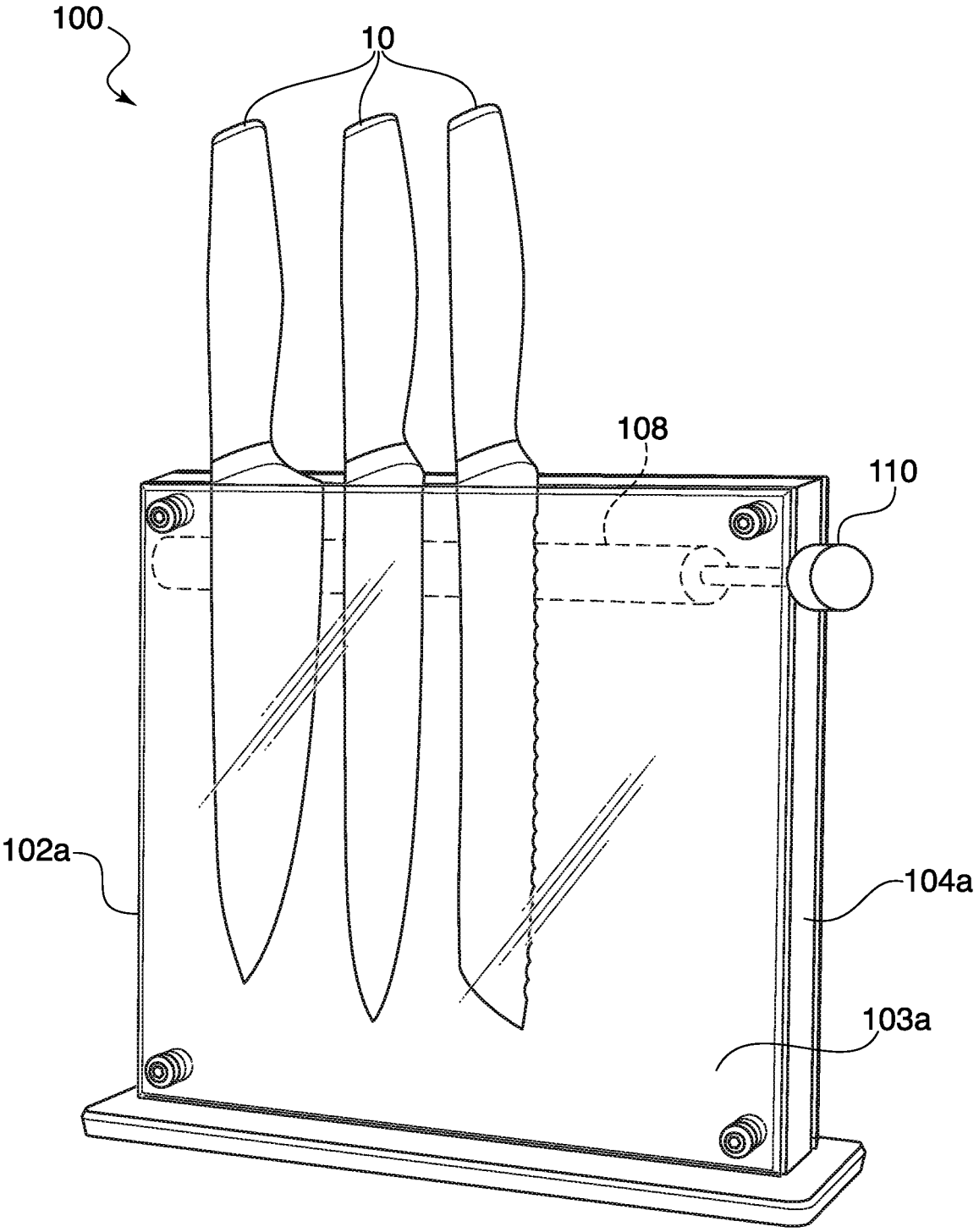
FIG. 1A is a perspective view of a locking knife holder according an embodiment of the invention.

FIG. 1A shows an embodiment of a knife locking system 100 where a rotating magnetic is implemented. The knife locking system 100 may include a knife holder 102 having a clear (plastic or glass) front 103 connected to a back block 104 such that the knives 10 slide between the clear front 103 and block 104 such that the knives are visually displayed. Inside the block 104 is positioned a rotating magnet 108, and a knob 110 extending outward therefrom. It will be appreciated that the knife holder 102 with clear front 103 is a decorative holder and is only an example of a knife holder to which the present invention is applicable. Those of skill in the art will appreciate that any knife holder that utilizes magnets to hold the knives could be implemented with the present invention.

In accordance with one implementation of the invention, the rotating magnet has different levels or strengths of magnetic force depending on which side is exposed to the front of the block or depending on distance relative to the slot.

Figure 1B:
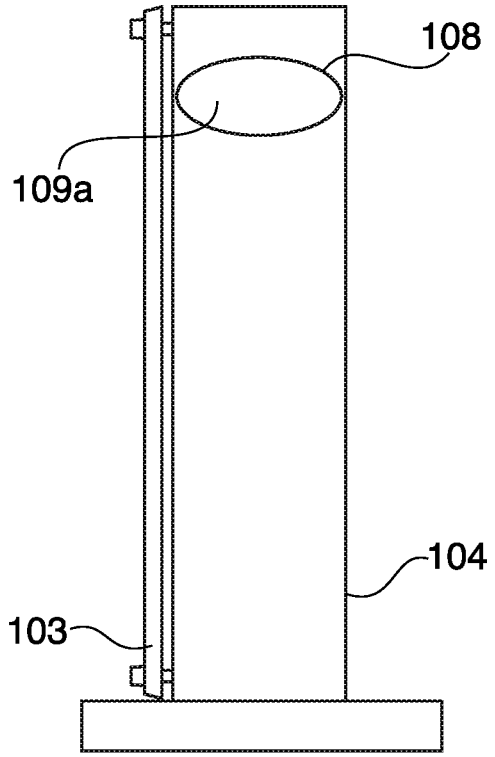
FIGS. 1B and 1C are partial cross-sectional views of the locking knife holder from FIG. 1.
Figure 1C:
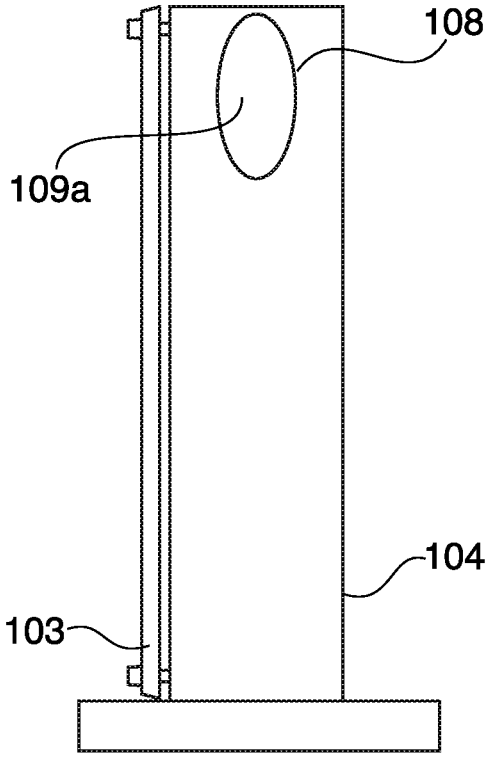

FIGS. 1B and 1C show an example of the rotating magnet 108 within the block 104 and in different orientations. In this example, the magnet 108 is oval in cross section and as such, when rotated along its axis will preferably have two operable positions, one being where a portion 109A of the magnet 108 is very close to the front surface of the block 104 (i.e., closest to the knives), and a second position where a portion 109B of the magnet 108 is positioned a little further away from the front of the block 104. In this manner, the strength of the magnet 108 as applied to (or relative to) the knives can be varied. Thus, when the rotated such that portion 109A is positioned as shown in FIG. 2A, the magnetic strength imparted onto the knife being retained by the magnet is increased simply by the magnet being closer to the surface of the block engaging the knife. This operates to "lock" or secure the knife in place such that it cannot be simply removed from the block. Once the knob 110 is rotated, and the magnet is oriented as show in FIG. 2B, the magnetic strength is decreased due to the increased distance from portion 109B and the front surface of the block engaging the knife, and the knife can now be removed from the block for use.

As can be appreciated from the above discussion, the ability to lock or secure the knives in place within the block provides an increased safety feature, particularly for households that have children who may try to play with the knives on the counter.

In some embodiments, the rotating magnetic 108 may include two different magnets of different magnetic strength levels. Half (or a portion thereof) of the rotating magnetic 108 may be composed of a magnetic with stronger magnetic properties. The other half (or portion thereof) of the rotating magnetic 108 may be composed of a magnetic with weaker magnetic properties. When the strong magnetic half faces the knives 104, a strong magnetic force is exerted on the knives 104 and a user is unable to remove the knives 104 from the knife holder 102. When the weak magnetic half faces the knives 104, a weak magnetic force is exerted on the knives and a user is able to remove the knives 104 from the knife holder 102.

Figure 2:
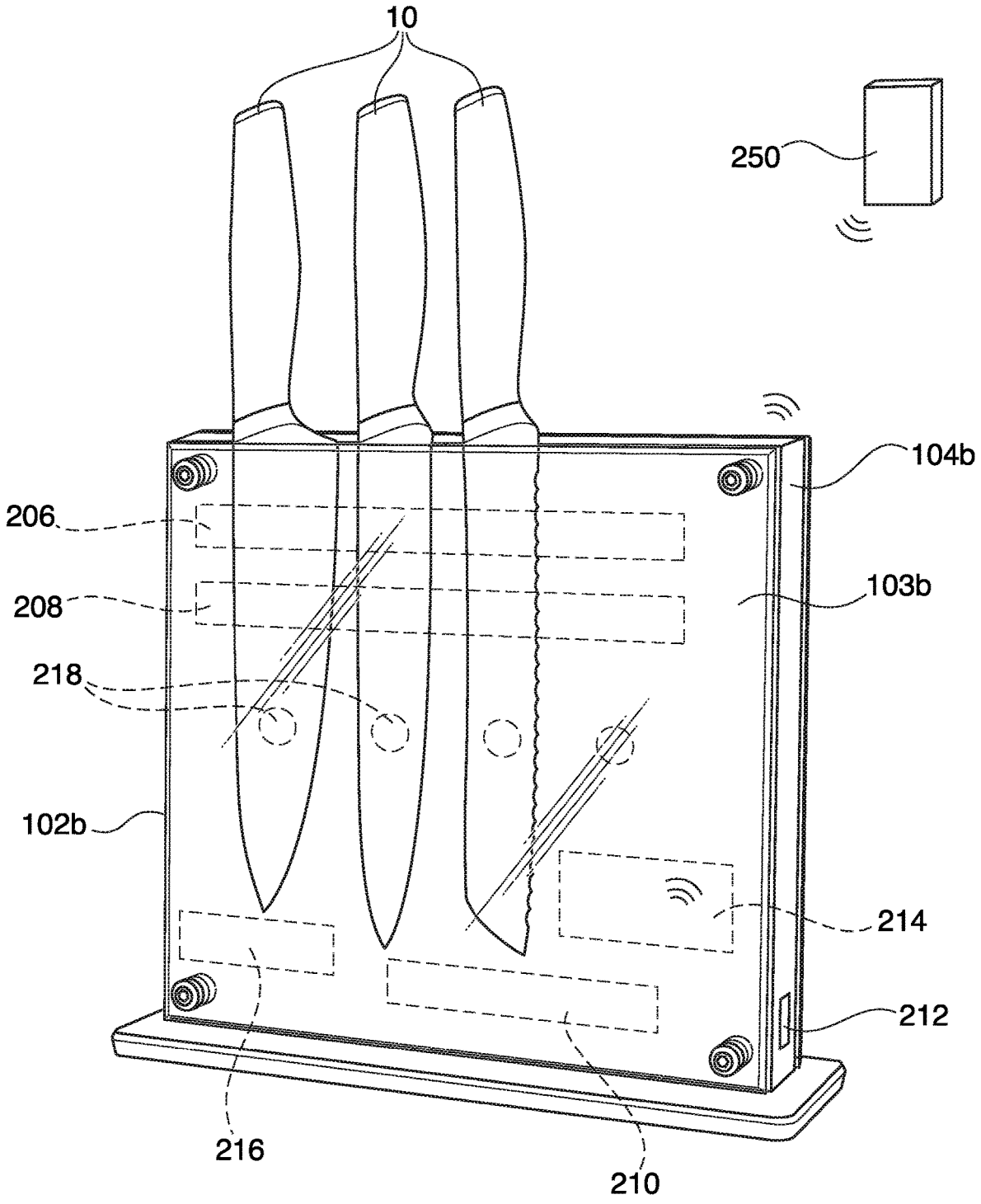
FIG. 2 is a perspective view of the locking knife holder according to a further embodiment of the invention.

Referring to FIG. 2, there is shown a locking knife holder 102B according to an alternative implementation of the present invention. According to this embodiment, a permanent magnet 206 is disposed in the back block 104B and operates to magnetically hold the knives 10 in the suspended position between the clear plastic or glass front 103B and allow the user to remove the same by simply pulling upward on the knife handle. The locking system consists of adding an electromagnet 208 to the back block 104B such that upon activation of the same, the magnetic strength holding the knives in place is significantly increased to the point where knives 10 cannot be removed from the holder 102B by simply pulling up on the same. A button or switch 212 is provided and connected to internal circuitry 210 that activates or deactivates the electromagnet 208 and thereby enables or disables the locking mechanism of the knife holder 102B. The power for the electromagnet can be provided by a DC power source such as a battery or AC connection at the user's location. Power supply 216 (AC or DC) is connected to the circuitry and the electromagnet 208.

In accordance with other contemplated implementations of the locking knife holder of the present invention, the holder can include one or more sensors 218 positioned such that they sense the presence or absence of a knife. Additionally, the holder can also include network circuitry 214 that is either wired (via an ethernet connection on the back of block—not shown) or via wireless network connections (e.g., Bluetooth, WiFi, etc.). In this manner, the knife holder can be connected to the user's home or business network and allow the user, for example, to remotely lock and unlock the same using their smartphone device 250 using an application designed for the same, or to sense and let the owner of the smartphone device 250 know when a knife is present or not, via sensors 218.

Figure 3A:
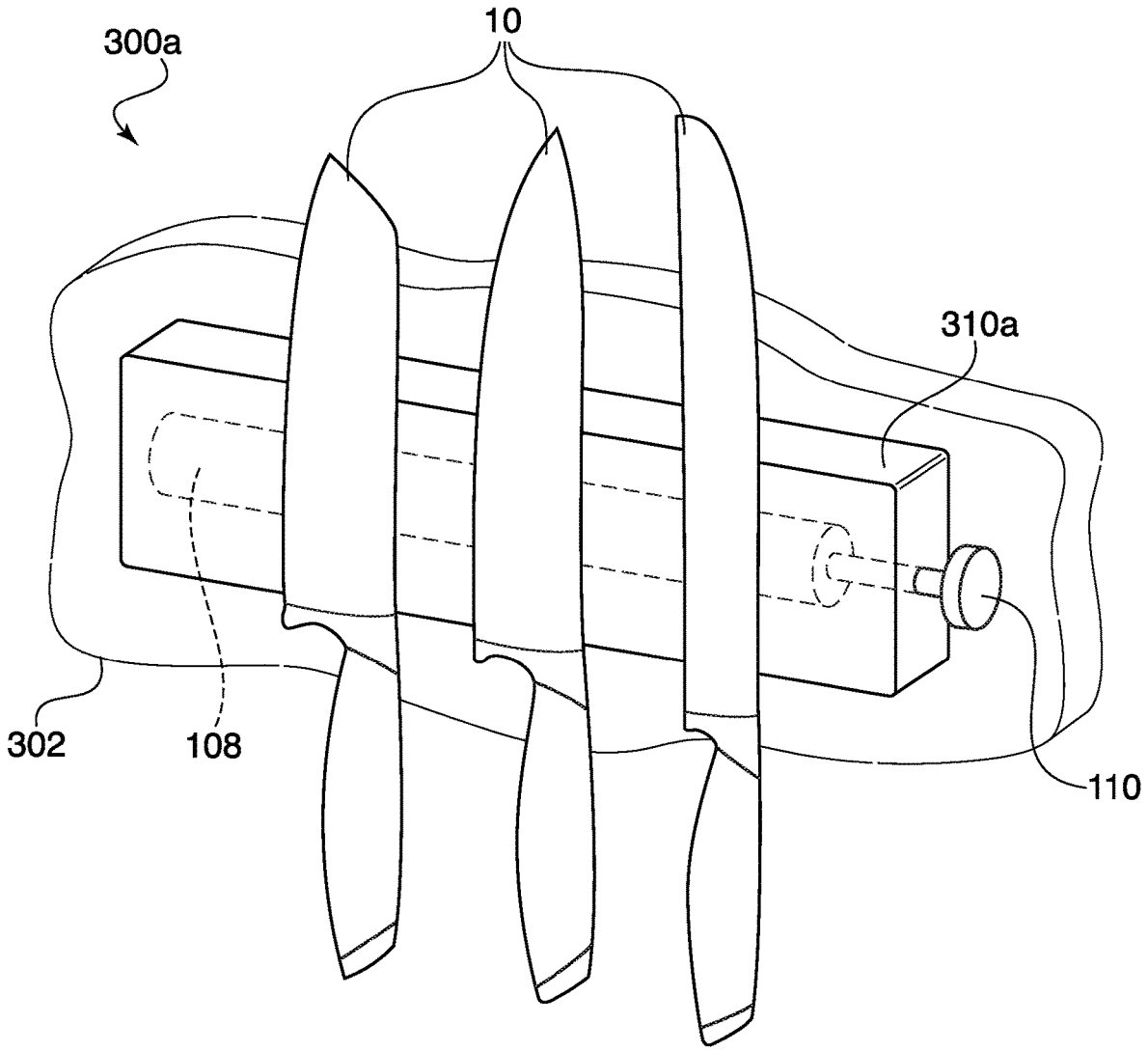
FIG. 3A is a perspective view of a locking knife holder according to yet another embodiment of the invention.

Referring now to FIG. 3A, there is shown a knife block system 300A of a different type. In this system, the block 310A is mounted on a wall 302 and includes the rotating magnet 108 disposed therein. As described above with respect to FIGS. 1A and 1B, the rotation of the magnet 108 changes the magnetic strength relative to the knife blades on the front surface, and thereby enables the user to "lock" the knives in place when not in use, and unlock them to a normal magnetic hold state where the user can simply remove then as needed. In this implementation, the magnet 108 can be manually rotated using knob 110.

Figure 3B:
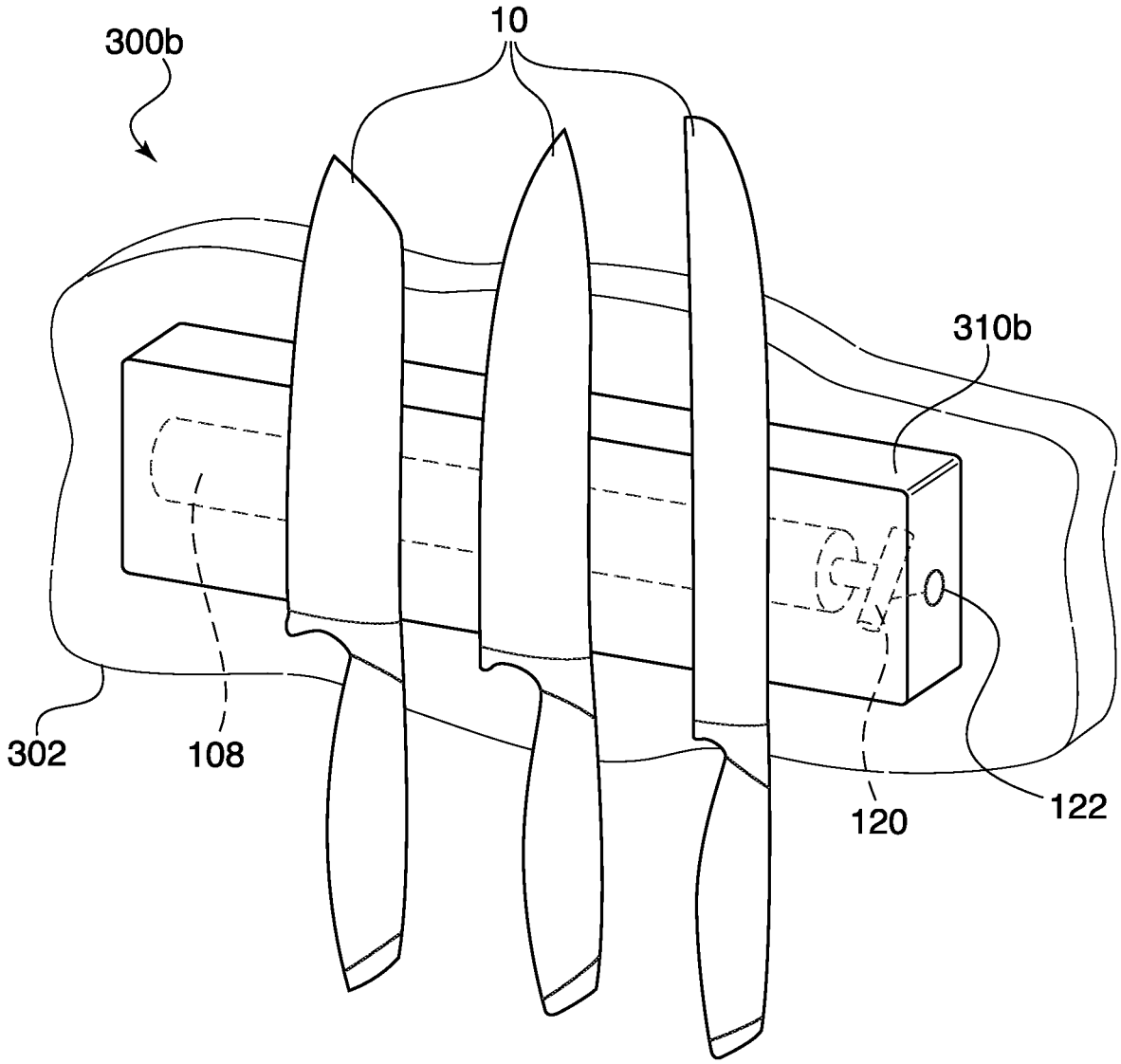
FIG. 3B is a perspective view of an alternative implementation of the locking knife holder shown in FIG. 3A, according to a further embodiment of the invention.

FIG. 3B shows another implementation where the rotating magnet 108 is electronically rotated using a servo type motor 120 that is connected to a power source (AC or DC now shown) and a button or switch 122. In this implementation, the user simply actuates the switch 122 and the motor 120 rotates the magnet 108 to change the strength of the same relative to the knives and thus lock or unlock the same from the block for use.

Figure 3C:
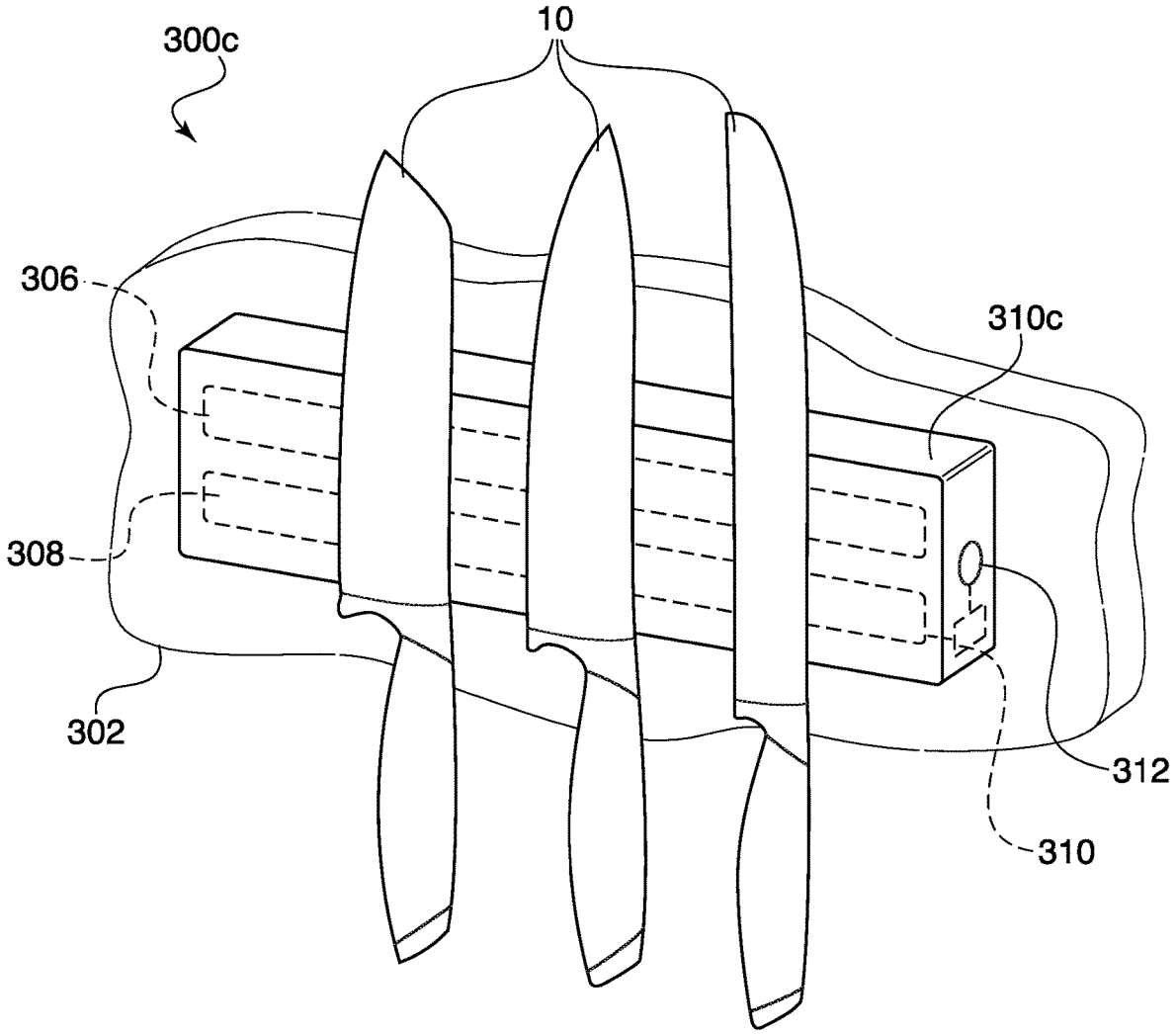
FIG. 3C is another perspective view of a yet another implementation of the locking knife holder shown in in FIG. 3A.

FIG. 3C shows another embodiment of a knife locking system 300 where an electromagnet is implemented. The knife locking system 300C may include a knife block 310C, a permanent magnetic 306, an electromagnet 308, circuitry 310, and a switch 312. In this implementation, the permanent magnet 306 will always operate to hold the knives against the front surface for use. When the user desires to lock or secure the knives in place, the user would activate the switch 312 which would activate the electromagnet 108. Once activated, the electromagnet imparts a much stronger magnetic force on the knives, preventing them from being easily removed from the block 310C. When user desires to use a knife, activation of the switch 312 will deactivate the electromagnet 108 and thus leave only the permanent magnet 306 to hold the knives, and thereby allow the user to easily remove the same.

Figure 4A:
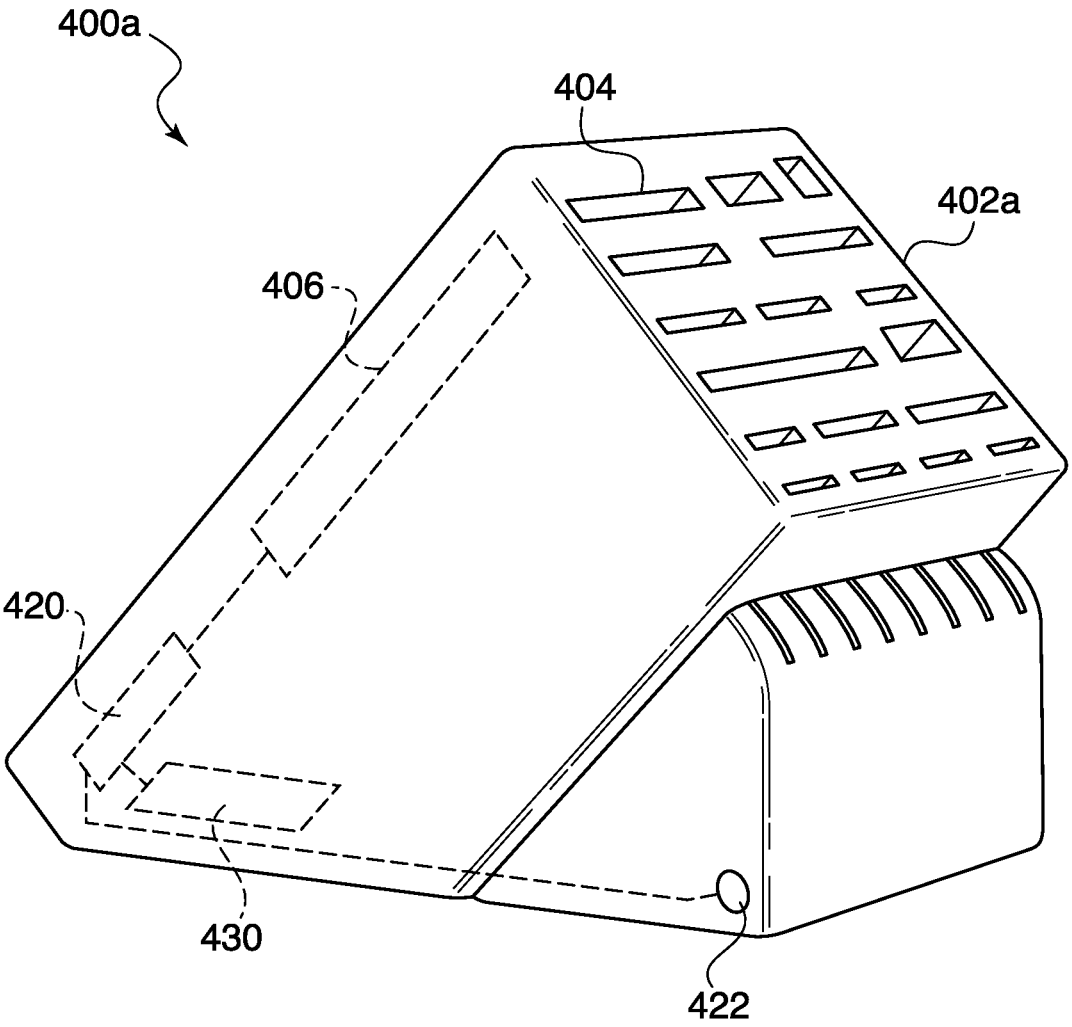
FIG. 4A is a perspective view of a knife block having a locking mechanism according to a further embodiment of the invention.

Referring now to FIG. 4A, there is shown a knife locking system 400A according to another embodiment of the invention. The knife locking system 400 includes a knife block 402 having a body with one or more slots 404 for receiving knives of different sizes. As will be appreciated, multiple permanent type magnets (not shown) can be disposed within the block 402 positioned around the slots 404 such that a knife inserted in the same is magnetically secured therein and can be removed by the user simply by pulling on the knife handle. However, in accordance with the present invention, additional electromagnets (e.g., 406) can be added into the block around one or more slots 404 in any configuration such that activation of switch 422 will operate internal circuitry 420 to activate or deactivate the electromagnets 406. In this manner, the one or more knives in the respective slots 404 can be magnetically locked into position within the same. As shown, a power source 430 is provided and connected to the circuitry 420 and can be any type of known power source, such as, for example, DC sources such as a replaceable battery or a rechargeable battery, or an AC source such as a connection to an AC outlet.

Figure 4B:
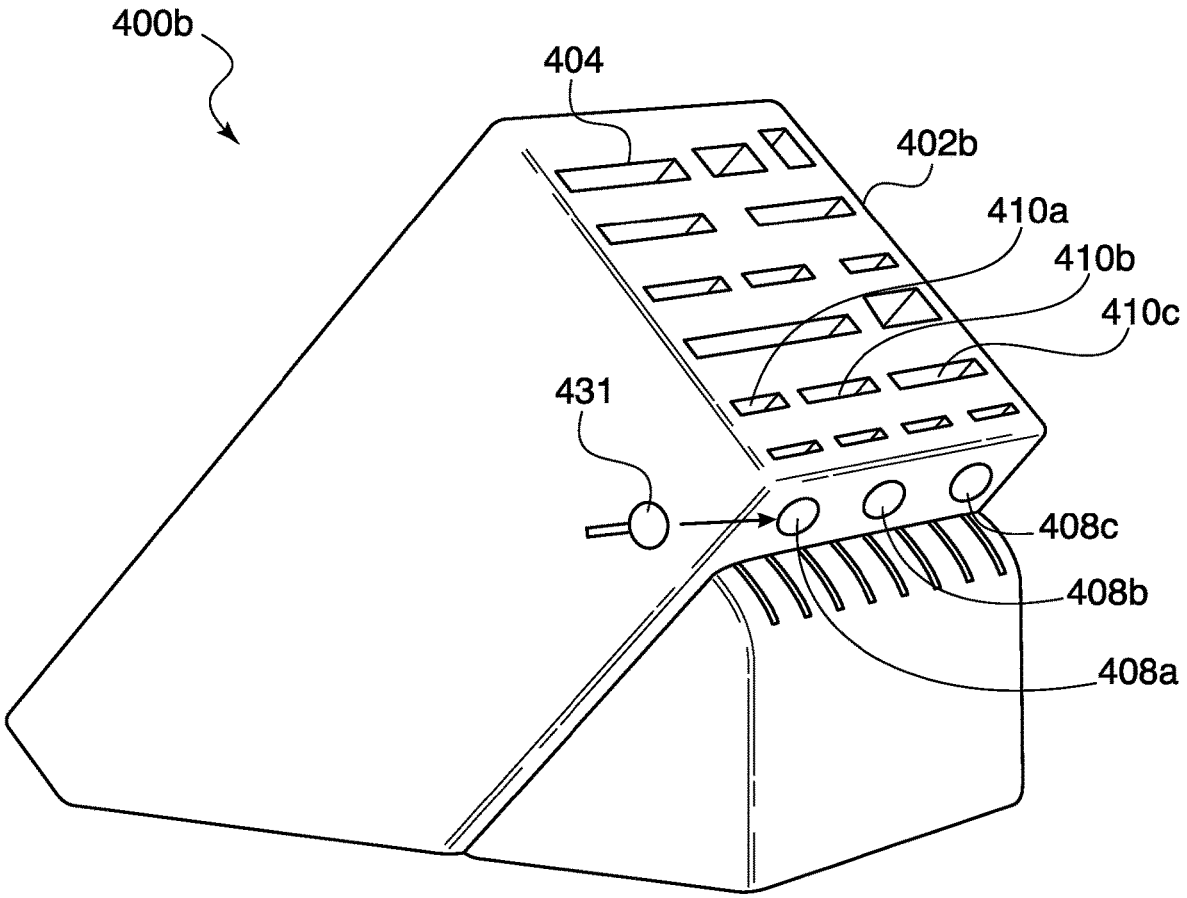
FIG. 4B is another perspective view of a knife block according to yet another embodiment of the invention.

Referring to FIG. 4B, there is shown another implementation of the knife block system 400B where the knife block 402B includes one or more mechanical systems for locking knives contained in one or more of the slots. In this example, slots 410A, 410B and 410C include internal mechanical systems that mechanically lock a knife inserted into the slot. As will be discussed with respect to FIGS. 5A-5D, contact points 408A, 408B and 408C are used to release the mechanical locks using an external magnet actuator 410. In this manner, the knife holder 402B is configured to reliably lock knives into place using the mechanical locking mechanism system. Although described with reference to a few slots (410A, 410B, and 410C), it will be appreciated that the mechanical locking mechanism can be integrated into all the knife receiving slots of the block body 402B.

Figure 5A:
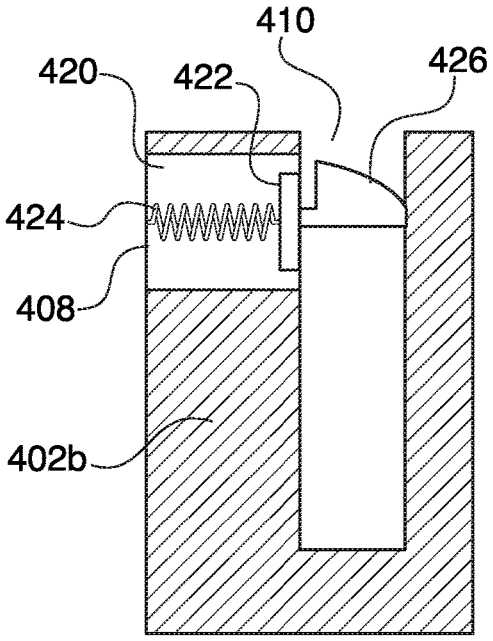
FIGS. 5A, 5B, 5C, and 5D illustrate an embodiment of a mechanical locking mechanism from the additional embodiment of the invention in FIG. 4B.

Referring now to FIGS. 5A, 5B, 5C, and 5D, a locking system 420 illustrates one example of a mechanical locking system implemented into the knife block 402B. The locking system 420 has a magnetic base 422 connected to a spring 424. A locking pawl or portion protrudes from the magnetic base 422 and extends into the knife receiving slot 410. The spring 422 is coupled at is opposing end to an inside surface of the block 402B. A magnetic key 430 has a base or handle 432 and a magnet 434. As shown in FIG. 5A, the locking pawl 426 is spring biased in a locking position across the opening of the slot 410. In other contemplated embodiments, the spring bias set by spring 424 is not needed and the locking system with magnetic release and other device/mechanisms can be used to bias the locking pawl as desired for use with the magnetic release.

Figure 5B:
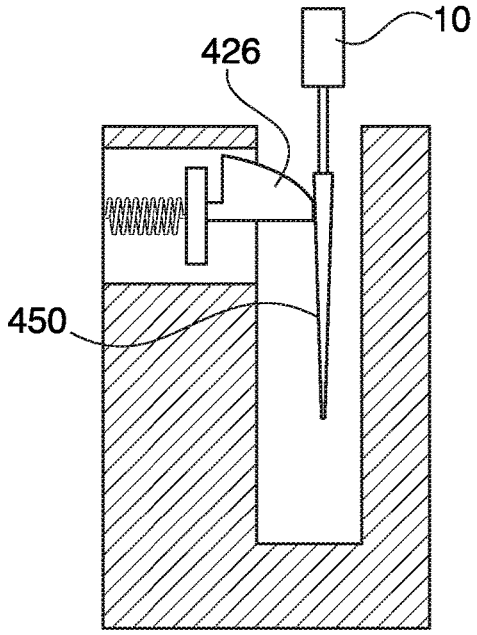
Figure 5C:
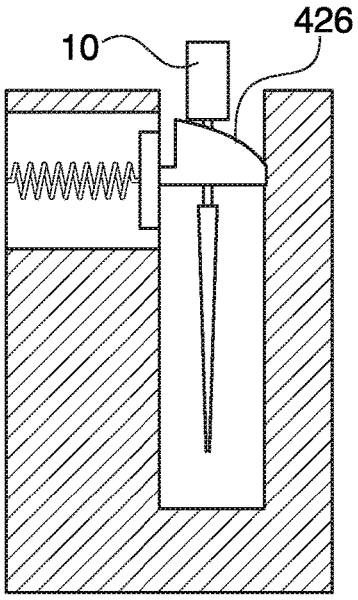
Figure 5D:
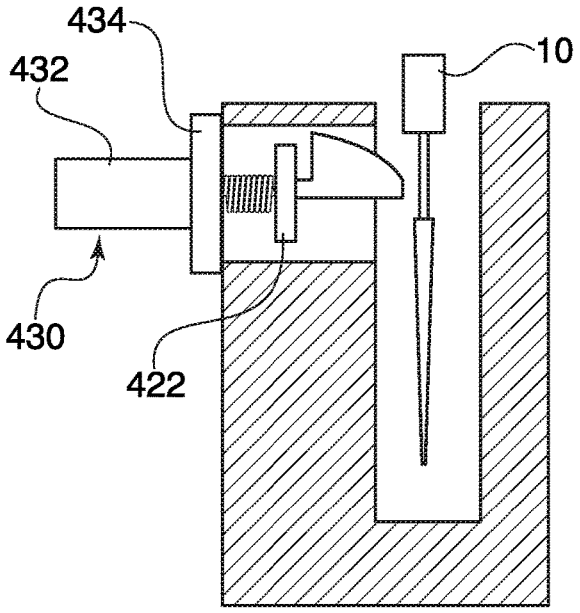

As shown in FIG. 5B, a knife blade 450 is inserted into the slot 410 and engages the sloped upper surface of the locking pawl 426 such that the same is pushed against its spring bias to allow the knife blade into the slot. At a certain point, the knife blade is completely inserted into slot 410 such that locking pawl 426 springs back into a void above the blade, thereby locking the same into the slot (See FIG. 5C).

In order to release the blade from the slot 410, the magnetic key 430 is placed against the reference point 408 outside the desired slot 410, and the magnet 434 of the key attracts the magnet 422 of the locking mechanism and draws the same toward the key (against the bias of spring 424) to remove the locking pawl 426 from the slot 410, thereby freeing the knife blade 450 and knife for use.

In accordance with other contemplated embodiments, the knife block and knives can be packaged together, and the mechanical locking system can be particular to the specific knives in the package. By way of one example, locking pawl 426 could be a cylindrical rod, and the knife blades could have a hole in them such that insertion of the knife into the block slot will cause the rod (at a predetermined point) to engage and pass through the hole in the blade, thus locking the knife into place within the slot. In another embodiment, the knives could simply have a notch at a predetermined point, and the locking pawl 426 is configured to fit into the notch when the knife is positioned in the slot.

While there have been shown, described and pointed out fundamental novel features of the present principles, it will be understood that various omissions, substitutions and changes in the form and details of the methods described and devices illustrated, and in their operation, may be made by those skilled in the art without departing from the spirit of the same. For example, it is expressly intended that all combinations of those elements and/or method steps which perform substantially the same function in substantially the same way to achieve the same results are within the scope of the present principles. Moreover, it should be recognized that structures and/or elements and/or method steps shown and/or described in connection with any disclosed form or implementation of the present principles may be incorporated in any other disclosed, described or suggested form or implementation as a general matter of design choice. It is the intention, therefore, to be limited only as indicated by the scope of the claims appended hereto.

What is claimed is:

1. A knife holder comprising:

a body having a block having a front surface;

a magnetic locking mechanism in communication with the front surface of the block and configured to selectively lock at least one knife blade against the front surface of the block, the magnetic locking mechanism having at least two distinct magnetic strength levels, a first of said at least two distinct magnetic strengths being high enough to prevent removal of the at least one knife blade from the front surface of the block, and a second of said at least two distinct magnetic strengths being high enough to retain the at least one knife blade against the front surface of the block and low enough to enable the at least one knife blade to be removed from the block by hand.

2. The knife holder of claim 1, wherein the magnetic locking mechanism comprises:

an electromagnet positioned in the body and configured to produce the first distinct magnetic strength;

a power source within the body and electrically connected to the electromagnet; and a switch accessible from outside the body and electrically connected to the power source and electromagnet.

3. A knife holder comprising:

a body having a front surface; and a rotating magnet disposed within body and having at least two distinct and different magnetic strengths relative to each other and the front surface, the at least two distinct magnetic strengths being determined based on a rotational position of the magnet relative to the front surface, such that in one predetermined rotational position a first of said two distinct magnetic strengths is high enough to prevent removal of a knife from the front surface by hand, and in a second predetermined rotational position, a second of said two distinct magnetic strengths is lower than the first distinct magnetic strength such that the knife is magnetically retained against the front surface of the body yet can be removed from the front surface by hand.

4. The knife holder of claim 3, further comprising a knob external to the body and connected to the rotating magnet, the knob enabling a user to manually rotate the magnet.

5. The knife holder according to claim 3, further comprising:

a motor connected to the rotating magnet;

a power supply connected to the motor; and a switch accessible from outside the body and connected to the motor and power supply and configured to rotate the magnet between the at least two distinct and different magnetic strengths.

6. The knife holder according to claim 2, further comprising at least one permanent magnet positioned in the block and configured to hold the at least one knife against the front surface of the block when the electromagnet is deactivated, said permanent magnet being the second of said at least two distinct magnetic strengths, the second magnetic strength being lower than the first magnetic strength to allow for removal of the at least one knife from the block.

7. The knife holder of claim 2, further comprising wireless communication circuitry positioned in the body and configured to enable the knife holder to be connected to and communicate with a user's home network, said wireless communication circuitry enabling a user to remotely determine a locked status of the locking mechanism.

8. A knife holder comprising:

a body having a front surface;

electronic circuitry inside the body;

at least one permanent magnet within the body, the at least one permanent magnet magnetically securing a knife blade against the front surface with a first magnetic strength;

at least one electromagnet electrically coupled to the circuitry and when activated further magnetically securing the knife blade against the front surface with a second magnetic strength without mechanically engaging the knife blade;

a switch electrically coupled to the circuitry and the at least one electromagnet and configured to selectively activate and deactivate the at least one electromagnet; and wherein the first magnetic strength is lower than the second magnetic strength, such that the knife blade stays attached to the front surface of the body under the first magnetic strength and can only be removed from the front surface by hand when the second magnetic strength of the electromagnet is deactivated and cannot be removed from the front surface of the body by hand when the second magnetic strength of the at least one electromagnet is activated.

9. The knife holder of claim 1, further comprising a front clear portion spaced from the front surface of the block to create a slot that receives the a at least one knife blade such that the at least one knife blade magnetically adhered to the front surface of the block is visible from the front of the block.

* * * * *